US006400077B1

(12) United States Patent
Michel et al.

(10) Patent No.: US 6,400,077 B1
(45) Date of Patent: Jun. 4, 2002

(54) ELECTRIC INCANDESCENT LAMP

(75) Inventors: Jean Pierre Alain Michel, Ban-St.-Martin; Laurent Claudel, Norroy les Pont a Mousson; Jean-Marc Voirpin, Strasbourg, all of (FR)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/743,838

(22) PCT Filed: May 11, 2000

(86) PCT No.: PCT/EP00/04403

§ 371 (c)(1),
(2), (4) Date: Jan. 16, 2001

(87) PCT Pub. No.: WO00/70652

PCT Pub. Date: Nov. 23, 2000

(51) Int. Cl.[7] ..... H01K 1/14; H01K 1/18; H01K 1/28

(52) U.S. Cl. ..... 313/578; 313/634; 313/273; 313/275; 313/279

(58) Field of Search ..... 313/578, 634, 313/315, 273, 275, 279

(56) References Cited

U.S. PATENT DOCUMENTS 5,101,138 A * 3/1992 Losonczi et al. ..... 313/578 X
5,523,650 A * 6/1996 Terheijden et al. ..... 313/578

FOREIGN PATENT DOCUMENTS

DE 1262469 3/1968

* cited by examiner

*Primary Examiner*—Ashok Patel
(74) *Attorney, Agent, or Firm*—Dicran Halajian

(57) ABSTRACT

The U-shaped electric incadescent lamp (1) is characterized in that, instead of a bend, one or more kinks (20) are made in the lamp vessel (2) so as to position the first leg (14) and the second leg (16) in a parallel arrangement next to each other at a relatively small distance. The lamp thus obtained is inexpensive, compact and safe.

9 Claims, 1 Drawing Sheet

ELECTRIC INCANDESCENT LAMP

The invention relates to an electric incandescent lamp comprising:

a quartz glass lamp vessel with a wall enclosing a space in a gastight manner, which lamp vessel has a U shape with a first leg and a second leg situated substantially parallel next to each other and connected to each other via an intermediate part, said legs defining a plane and a longitudinal axis of the lamp;

a first portion and a second portion of an incandescent body accommodated in the first leg and the second leg, respectively, and connected to each other via an intermediate portion of the incandescent body;

seals having respective feedthroughs comprising metal foils embedded in the wall, the feedthroughs being connected to the respective first portion and second portion of the incandescent body and extending to the exterior.

Such an electric incandescent lamp is known from DE-1.262.469. The known U-shaped lamp is made of tubular quartz glass, with a $\mu$ $SiO_2$-content of at least 95% by weight, with an inner diameter. The mutual position of the first leg and the second leg, being arranged next to each other, is obtained via a relatively smooth bend in the intermediate part. Since the U shape of the lamp is obtained by bending the lamp with the incandescent body already inserted into the lamp, it is essential that the incandescent body is kept at a distance from the wall of the lamp vessel to prevent substantial parts of the incandescent body from being incorporated in the wall during shaping of the bend. To this end, the incandescent body is supplied with incandescent body supports. The incandescent body can be held at a distance from the wall of the lamp vessel by these incandescent body supports because the inner diameter of the tubular glass is substantially unaltered in the smooth bend in the intermediate part. A disadvantage of the known lamp is that shaping of the bend is a time-consuming and expensive process that needs accurate processing. Another disadvantage of the lamp is that, due to the relatively large distance between the legs, it takes up relatively much space.

It is an object of the invention to provide a lamp of the kind described in the opening paragraph, which is compact and can be readily obtained at relatively low costs.

According to the invention, this object is achieved by a lamp of the kind described in the opening paragraph, which is characterized in that the lamp vessel is formed to the U shape by a kink in the intermediate part of the lamp vessel. It is equally possible that the lamp vessel is formed to the U shape by more kinks, e.g. two kinks, in the intermediate part of the lamp vessel. The lamp vessel is made of normal tubular quartz glass and the kink in the intermediate part is readily obtained because only a relatively small part of the lamp vessel needs to be heated and the formation of the kink needs less accurate processing than shaping of a bend. By making a kink instead of a bend in the lamp vessel, the risk of incorporating substantial parts of the incandescent body in the wall is counteracted as well. Furthermore, in this way, a compact lamp is obtained with a relatively small distance between the legs and the seals. The size of the lamp comes close to the size of equivalent single-ended lamps with only one seal. However, the two separate seals and the separate legs give the lamp the advantage of a smaller chance of electrolysis and arcing in comparison with single-ended lamps having a U-shaped incandescent body in a tubular lamp vessel and having two feedthroughs in one integrated seal. A further advantage of the lamp over a single-ended lamp, having a tubular lamp vessel with a U-shaped incandescent body, is that the risk of short-circuiting the first portion with the second portion of the incandescent body is practically impossible because these portions are separated. The separation between the first and the second portion of the incandescent body is obtained in a relatively simple way by the wall of the lamp vessel.

An embodiment of the electric incandescent lamp is characterized in that the metal foils, having a respective flat surface, extend substantially parallel to said longitudinal axis and have their respective flat surface situated in said plane. The shape of the metal foil is superimposed on the shape of the seal during manufacture of the seal, e.g. a pinch. Hence, relatively flattened seals are obtained, so that the lamp, apart from being compact, is relatively flat, too.

A further embodiment of the electric incandescent lamp is characterized in that the metal foils, having a respective flat surface, extend substantially parallel to said longitudinal axis and have their respective flat surface positioned substantially transverse to said plane. When the flattened seals are positioned substantially transverse to the plane defined by the first and the second leg, the feedthroughs can be positioned even at a closer distance from one another. Hence, an even more compact lamp is obtainable with a size that comes even closer to the size of equivalent single-ended lamps with only one seal.

Another embodiment of the electric incandescent lamp is characterized in that the incandescent body is free from incandescent body supports. A disadvantageous of the known lamp is that these incandescent body supports increase the price of the lamp and that the incandescent body support hampers its insertion into the lamp vessel. Analogous to the known lamp, in the lamp according to the invention, the deformnation for shaping (the kink in) the U-shaped lamp vessel is affected with the incandescent body already inserted in the lamp vessel. However, since only a relatively small part of the lamp vessel needs to be heated, only a relatively small part of the incandescent body might be incorporated in the wall. Hence, incandescent body supports are not necessary. During deformation of the lamp vessel, opposite wall parts of the intermediate part of the lamp vessel have approached each other, leaving only a slit open in the finished kink, in which slit a small part of the incandescent body is clamped or incorporated in the wall. In this way, the incandescent body is kept in a fixed position in the lamp without use of the incandescent body supports. By elimination of the incandescent body supports, the manufacture of the lamp has become even simpler and cheaper.

In a favorable embodiment, the electric incandescent lamp is characterized in that the intermediate portion of the incandescent body comprises a straight section locally at the kink of the U-shaped lamp vessel. During operation of the lamp, the incandescent body reaches temperatures of over 2500 K. When the incandescent body touches a spot on the wall of the lamp vessel, the wall has a cooling effect on the incandescent wire at this spot. Despite the cooling effect, the still relatively high temperature of the normally triple-coiled incandescent body, increases the risk of early failure of the lamp because of wall attack via melting and crystallization of the quartz glass of the wall. The triple-coil structure of the incandescent body allows a relatively large length of its incandescent wire to be put into a small volume without short-circuiting the incandescent wire. Apart from the fact that a relatively high amount of light radiation of the incandescent body is obtained in this small volume, a relatively high amount of heat generation in this small volume is obtained, too. If the incandescent body is locally not a triple-coil but comprises a straight section in the incandescent wire, the amount of heat generation at this straight section in the same small volume is decreased significantly. Hence, the local cooling effect of the wall on the straight section of the incandescent body at the spot where it touches the wall, is relatively stronger. The cooling effect thus obtained is sufficient to cool the straight section of the incandescent body to a temperature at which the risk of wall attack is decreased significantly. Hence, the risk of early failure of the lamp is decreased.

In a very favorable embodiment, the electric incandescent lamp is characterized in that the straight section is substantially non-light-emitting. The risk of wall attack due to the high temperature of the incandescent body is then reduced even further due to the relatively low temperature of the straight section.

The electric incandescent lamp can be used for general lighting applications and may have a gas filling, containing, apart form an inert gas, a halogen or a halogen-containing compound, like hydrogen bromide. The lamp may operate at a relatively low power of, e.g. 25 or 150 W. The lamp may be designed for use at the mains voltage, e.g. 110 or 230–240V.

Embodiments of the electric incandescent lamp according to the invention are shown schematically in the drawings in which.

Figure 1:
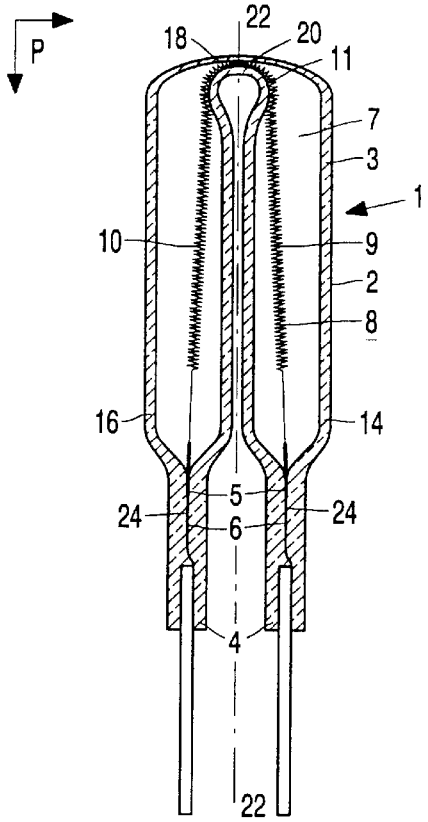
FIG. 1 is a side-elevation of the electric incandescent lamp.

The electric incandescent lamp 1 of FIG. 1 has a quartz glass lamp vessel 2 with a wall 3 enclosing a space 7 in which a coiled incandescent body 8 is arranged. The lamp vessel 2 has a U shape and is sealed in a gastight manner by seals 4, in the Figure a pinch seal, having respective feedthroughs 5, comprising metal foils 6 embedded in the wall 3. The feedthroughs 5 extend to the exterior and are connected to the incandescent body 8 having a first portion 9 and a second portion 10 connected to each other via an intermediate portion 11. The lamp vessel 2 is bent into a U shape via an intermediate part 18 having a kink 20 with a first leg 14 and a second leg 16 connected via the intermediate part 18. The first leg 14 and the second leg 16 are arranged next to each other at a relatively small distance, and said legs define a plane P and a longitudinal axis 22 of the lamp 1. The metal foils 6, having a respective flat surface 24, extend substantially parallel to the longitudinal axis 22. The flat surface 24 of the respective metal foil 6 can be oriented in all directions with respect to the plane P. In the Figure, however, the flat surfaces 24 are positioned substantially transverse to said plane P.

Figure 2:
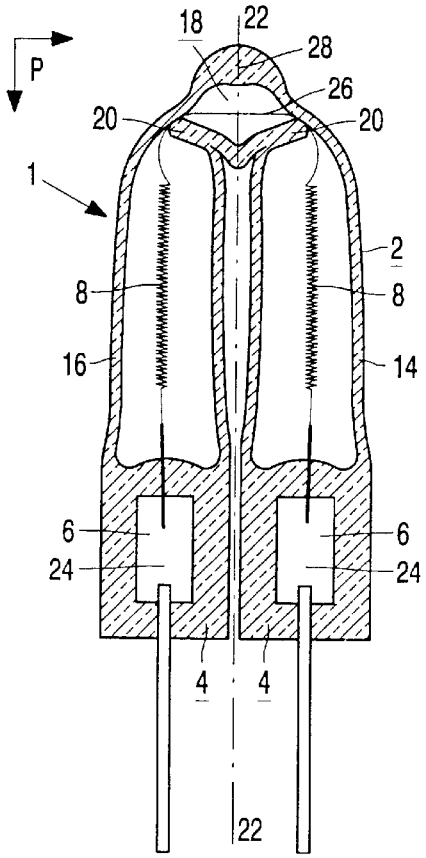
FIG. 2 shows a second embodiment of the electric incandescent lamp.

The electric incandescent lamp 1 of FIG. 2 has seals 4 whose metal foils 6 extend substantially parallel to the longitudinal axis 22 and have their respective flat surface 24 situated in the plane P. The lamp vessel 2 is formed to the U shape by two kinks 20 in the intermediate part 18 of the lamp vessel 2. The incandescent body 8 locally comprises a straight section 26 at the kinks 20 of the U-shaped lamp vessel 2. In the Figure, the remainder of an exhaust tube 28 of the lamp vessel 2 is present between the two kinks 20 in the intermediate part 18, but it is also possible to position the exhaust tube in the legs 14, 16.

What is claimed is:

1. An electric incandescent lamp comprising:

a quartz glass lamp vessel with a wall enclosing a space in a gastight manner, which lamp vessel has a U shape with a first leg and a second leg situated substantially parallel next to each other and connected to each other via an intermediate part, said legs defining a plane and a longitudinal axis of the lamp;

a first portion and a second portion of an incandescent body accommodated in the first leg and the second leg, respectively, and connected to each other via an intermediate portion of the incandescent body;

seals having respective feedthroughs comprising metal foils embedded in the wall, the feedthroughs being connected to the respective first portion and second portion of the incandescent body and extending to the exterior, wherein the lamp vessel is formed to the U shape by two kinks in the intermediate part of the lamp vessel.

2. A lamp as claimed in claim 1, wherein the metal foils, having a respective flat surface, extend substantially parallel to said longitudinal axis and have their respective flat surface situated in said plane.

3. A lamp as claimed in claim 1, wherein the metal foils, having a respective flat surface, extend substantially parallel to said longitudinal axis and have their respective flat surface positioned substantially transverse to said plane.

4. A lamp as claimed in claim 1, wherein the incandescent body is free from incandescent body supports.

5. A lamp comprising:

a vessel with a wall enclosing a space in a gastight manner, said vessel having a U shape with a first leg connected to a second leg by an intermediate part, a light source located in said first leg and said second leg, wherein said first leg and said second leg are formed to the U shape by two kinks in the intermediate part of the vessel.

6. A lamp as claimed in claim 5, wherein said first leg and said second leg define a plane and a longitudinal axis of the lamp;

a first portion and a second portion of said light source being accommodated in the first leg and the second leg, respectively, and connected to each other via an intermediate portion of the light source;

seals having respective feedthroughs comprising metal foils embedded in the wall, the feedthroughs being connected respectively to said first and second portions of the light source and extending to an exterior of the lamp.

7. A lamp as claimed in claim 6, wherein the metal foils extend substantially parallel to said longitudinal axis and each foil has a respective flat surface situated in said plane.

8. A lamp as claimed in claim 6, wherein the metal foils extend substantially parallel to said longitudinal axis and each foil has a flat surface positioned substantially transverse to said plane.

9. A lamp as claimed in claim 6, wherein the light source is supported without the use of light source supports.

* * * * *